US008100071B2

(12) United States Patent
Janeke et al.

(10) Patent No.: US 8,100,071 B2
(45) Date of Patent: Jan. 24, 2012

(54) SEWING MACHINE WITH LARGE STITCH WIDTH

(75) Inventors: Rolf Janeke, Jönköping (SE); Fredrik Berglund, Huskvarna (SE); Lars Roos, Ulricehamn (SE)

(73) Assignee: KSIN Luxembourg III, S. ar.l, Luxembourg (LU)

( * ) Notice: Subject to any disclaimer, the term of this patent is extended or adjusted under 35 U.S.C. 154(b) by 1218 days.

(21) Appl. No.: 11/878,251

(22) Filed: Jul. 23, 2007

(65) Prior Publication Data

US 2008/0121158 A1 May 29, 2008

(30) Foreign Application Priority Data

Nov. 28, 2006 (SE) ..... 0602529

(51) Int. Cl.
*D05B 3/00* (2006.01)

(52) U.S. Cl. ..... 112/475.17; 112/102.5; 700/136

(58) Field of Classification Search ..... 112/102.5, 112/456, 470.01, 470.04, 470.06, 475.17; 700/136–138
See application file for complete search history.

(56) References Cited

U.S. PATENT DOCUMENTS 4,187,794 A * 2/1980 Ross et al. ..... 112/470.03
4,404,919 A * 9/1983 Martell et al. ..... 112/470.02
4,432,293 A 2/1984 Arendash
4,491,080 A * 1/1985 Hager ..... 112/475.02
4,622,907 A * 11/1986 Kimura ..... 112/102.5
4,706,584 A * 11/1987 Senda et al. ..... 112/470.03
4,901,660 A * 2/1990 Takeuchi et al. ..... 112/470.03
6,098,559 A * 8/2000 Hirose ..... 112/102.5
6,263,815 B1 * 7/2001 Furudate ..... 112/475.02
2003/0131773 A1 * 7/2003 Schweizer ..... 112/102.5

* cited by examiner

*Primary Examiner* — Nathan Durham

(74) *Attorney, Agent, or Firm* — Venable LLP; Eric J. Franklin

(57) ABSTRACT

A method and device applicable to a sewing machine which has a needle and a gripper with a horizontally positioned lower bobbin for executing a seam with stitches in a sewing material being sewn, for compensating a deficiency in a longitudinal shift of the needle during a stitch being caused by an arcuate movement of the needle when it shifts sideways in a stitch, wherein the method includes the material being advanced by a feeder a length $y_n$ in the longitudinal direction of the seam on the basis of the seam setting, and wherein the sewing machine has a control including an algorithm causing the feed motor to set the feeder, so that at each stitch which includes sideways shifts of the needle it advances the sewing material a correction length $e_n$ in the longitudinal direction of the seam, thereby compensating a corresponding deficiency in the needle's longitudinal shift relative to the material during the stitch being caused by the needle's arcuate sideways movement.

11 Claims, 3 Drawing Sheets

SEWING MACHINE WITH LARGE STITCH WIDTH

CROSS-REFERENCE TO RELATED APPLICATIONS

This application claims priority to Swedish patent application 0602529-0 filed 28 Nov. 2006.

FIELD OF THE INVENTION

The present invention relates to a sewing machine which has a horizontally disposed lower bobbin with a device and a method for control of the machine so that an increase in the stitch width can be achieved as compared with conventional sewing machines of a corresponding type.

BACKGROUND OF THE INVENTION

There are currently on the market a number of appliances with different configurations for forming lock stitches in order to produce a seam in a piece of material being sewn, said piece of material hereinafter referred to for the sake of simplicity as fabric. Ordinary domestic sewing machines conventionally involve the use of an upper thread and a lower thread on a bobbin which in cooperation with a needle causes the upper thread to execute a lock stitch in the fabric being sewn in the sewing machine.

Sewing machines of the lock stitch type have since a long time been part of the state of the art and their mode of operation is well-known. Taking, for the sake of simplicity, a sewing machine with a single needle as an example, such a machine forms stitches by the upper thread and the lower thread being linked together by the needle moving to and fro through a fabric which is moved forward across a sewing table, which is usually in a plane substantially perpendicular to the length of the needle. Most conventional sewing machines of this kind have a take-up lever which pulls the upper thread from an upper thread storage bobbin. The take-up lever provides the needle with the upper thread by an oscillating movement towards and away from the fabric. The expression "upper" hereinafter means the side of the fabric where the needle is housed. "lower" means the side of the fabric where the making of a knot is effected. Also, the expression "thread" hereinafter always means "upper thread" unless otherwise indicated.

When the take-up lever is in its highest position, a maximum amount of thread has been drawn out for the next stitch, after which the movement of the take-up lever reverses back downwards. After the take-up lever's reversal, the thread will form a loop under the fabric, since the effect of friction in the fabric will result in not all of the thread drawn out being immediately drawn back by the take-up lever.

The lower thread is unwound from a lower bobbin accommodated in a gripper under the fabric. The gripper may be of a rotating type and equipped with a gripper tip (sometimes called gripper arm) which in the course of the gripper's rotary movement hooks into the loop formed by the upper thread and in its continuing movement leads the upper thread round the lower bobbin.

When the oscillating movement of the take-up lever takes it upwards away from the fabric, the take-up lever draws surplus upper thread back, i.e. the amount of thread not consumed in the respective stitch. The thread drawn forward constituting said loop will thus be pulled tight so that a lock stitch is formed by the upper thread and the lower thread in cooperation, since the gripper has led the upper thread round the lower thread. A feeder on the sewing machine will then move the fabric forward for a subsequent stitch.

Said oscillating movements executed by the needle, the take-up lever and the gripper are mutually synchronised and are repeated cyclically for each stitch executed with the sewing machine.

Generally, a gripper system is nowadays so configured that the gripper rotates about a lower thread bobbin. A distinction may be made among gripper systems of two types, one of them with the gripper rotating in the horizontal plane, the other with the gripper rotating in the vertical plane, parallel with the needle. To achieve advantages with horizontal grippers, they have to be situated ahead of the needle, which makes it easier to reach a lower thread bobbin case in order to change the bobbin or the thread on it without having to remove the fabric from the sewing table. The gripper system used in the sewing machines referred to in this application has a horizontally disposed gripper. The gripper is provided with a bobbin basket, in which the lower thread bobbin is placed. During sewing, the bobbin remains stationary while the gripper rotates about it.

The needle directing the upper thread is fitted to the bottom of a needle rod which, synchronously with the other parts of the sewing machine involved in forming a stitch, moves the needle up and down in an oscillating movement. The needle is also allowed to move sideways synchronously with the formation of stitches. Sideways movement of the needle is necessary in the case of stitches required to have a width, i.e. to have the thread move a distance sideways across the fabric during sewing. This involves a difficulty in the case of a horizontally fitted lower bobbin, since the needle has to be adjacent to the gripper when said loop is formed if a safe capture of the loop should be rendered possible for the gripper. Accordingly, the sideways movement of the needle in the horizontal plane has to follow a slightly curved path adapted to the radius of the gripper in its rotary movement. This is readily observable on a domestic sewing machine, where a stitch plate serving as support for the fabric and at the same time covering the lower bobbin space is provided with and discloses a needle hole with a curved path, whereas the corresponding path on a sewing machine with a vertical lower bobbin is straight.

The mechanical components of the sewing machine with a horizontal lower bobbin are so arranged that the needle rod describes a movement along a conical surface, which movement is synchronised with that of the gripper. The technology for the movement of the needle in this context is known and is not further discussed here.

An example of prior art technology for a sewing machine of the type discussed herein is, as an example, described in U.S. Pat. No. 4,432,293, the content of which is hereby in its entirety incorporated in the present description.

As a consequence of the aforesaid curved path which the needle follows in the horizontal plane, it is clearly observable, on a finished stitch which has a width, that the thread follows a curved path if the sideways deviation is sufficient.

SUMMARY OF THE INVENTION

An operator intending to execute correctly positioned stitches of greater width, using a sewing machine of the kind described, therefore cannot generally achieve this on such a machine of conventional kind. Particularly, in decorative sewing or the sewing of alphabetic characters, greater stitch width would afford more potential for variation.

An object of the present invention is to propose a solution to the difficulties described above.

An aspect of the invention refers to a solution which allows an increase in stitch width on sewing machines with a horizontally disposed lower bobbin. When the thread moves sideways, as mentioned above, and follows the aforesaid arcuate path on an execution of a stitch, this entails a sideways shift of the needle in the conventional type of sewing machines and causes an unaesthetic result if completed stitches are of great width and especially where a plurality of wide stitches form a pattern. During the sideways shift of the needle in the arcuate path, the fabric is fed forward mechanically in the sewing (longitudinal) direction according to the stitch length setting, so that subsequent stitches applied to the fabric will be initiated and accomplished, with respect to fabric feeding, by the mechanical feeding of the machine according to stitch lengths which are valid for the stitches in their longitudinal direction. Instead, since the needle follows a curved path, an actual stitch length will be shorter because an actual stitch path projected in the longitudinal direction comprises a distance which is somewhat too short in the longitudinal direction. A discrepancy, an error, occurs between the actual longitudinal advance effected for the stitch and the vertical length of the stitch, i.e. its projection in the longitudinal direction. This is illustrated in FIG. 4 and described in more detail below. A solution to this problem, according to the invention, is to correct the error by causing the feeder to compensate the longitudinal advance of the fabric in proportion to the error. The error is based on the fact that the feeder on conventional machines cyclically feeds the length set by the machine without regard to the actual length of the stitch, which may vary, as indicated above, because of the curved path the needle follows across the fabric during performance of the stitch.

There are means for compensating the appearance of a seam for a certain width and a certain lateral position of the needle, but a remaining problem is that a pattern/seam which is compensated will still be distorted where the width/lateral position deviates from the compensation applied. No such problem arises if the device and the method according to the present invention are applied.

On a sewing machine which has a horizontally disposed lower bobbin and is also provided with a stepping motor which causes the feeder to advance the fabric according to the stitch length, the solution according to the invention comprises the stepping motor for the longitudinal feed being caused to advance the fabric at each step according to an algorithm which compensates for the abovementioned error which occurs on performing very wide stitches. The compensation here described might presumably also be achieved by a mechanical device in a sewing machine which does not have the feed powered by a stepping motor as here described. Such mechanically effected compensation is likely to be very complicated and therefore expensive, so the measure described according to the invention has great advantages. The feed error compensation described makes it possible for the total stitch width to be increased to at least 9 mm on a conventional home sewing machine without a re-structure of the complete machine.

An advantage of the device according to the invention is of course that the availability of increased stitch width on the sewing machine opens up a more wide field of application in that wider stitches can be used in decorative sewing and the sewing of alphabetic characters. Moreover, the measures according to the invention are not particularly expensive, since all that is required is that the control program for the stepping motor for the longitudinal feeder is programmed into the control program of the sewing machine and that the mechanical components affected by the possible wider stitches are adjusted to the increased stitch width, as described below.

DETAILED DESCRIPTION OF EMBODIMENTS OF THE INVENTION

A number of embodiments of the invention are described below with reference to the attached drawings.

Figure 1:
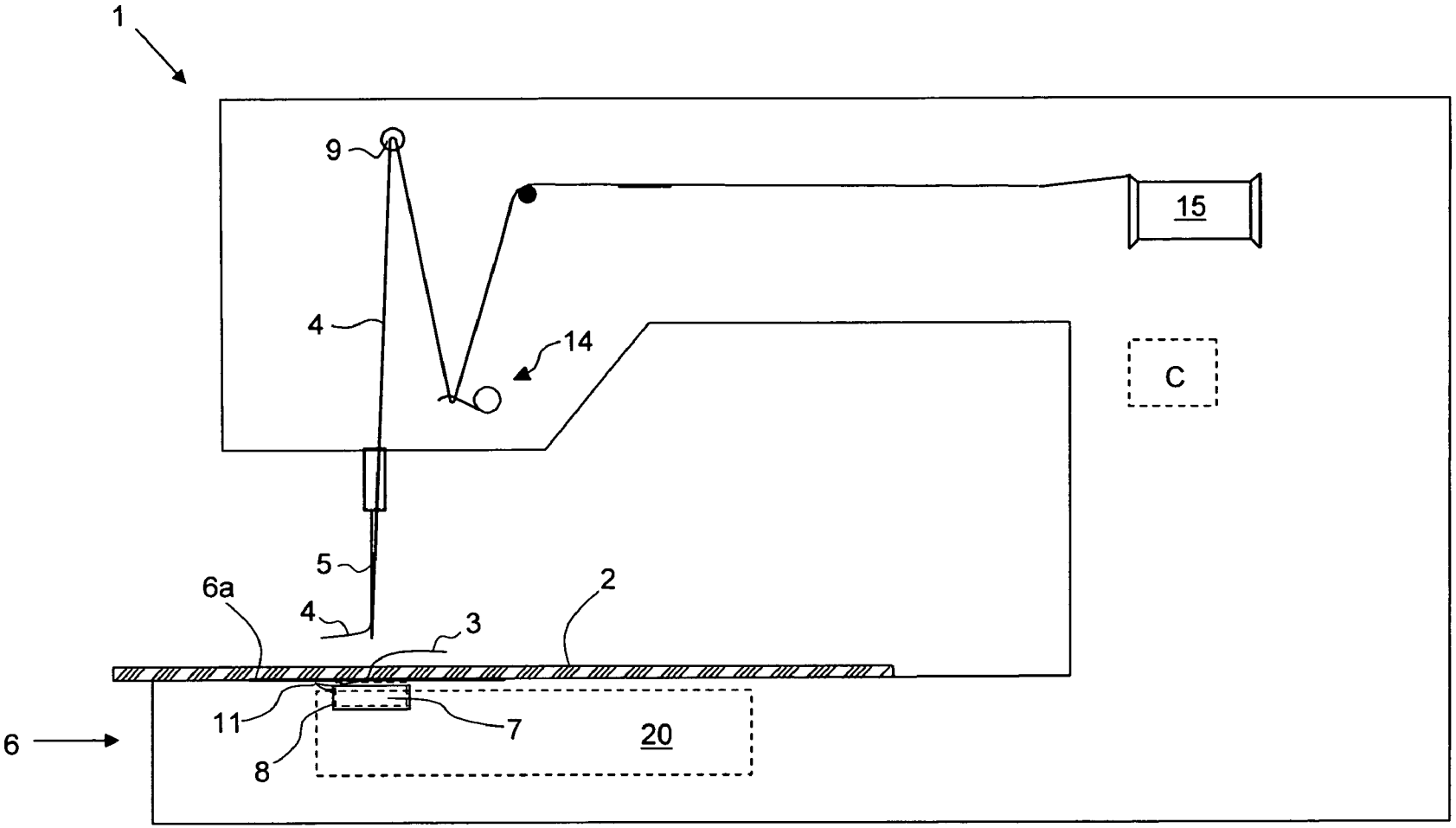
FIG. 1 depicts a schematic template drawing of a front view of a sewing machine with a horizontally positioned lower bobbin and a longitudinal feed unit indicated in the lower arm of the machine.
Figure 2:
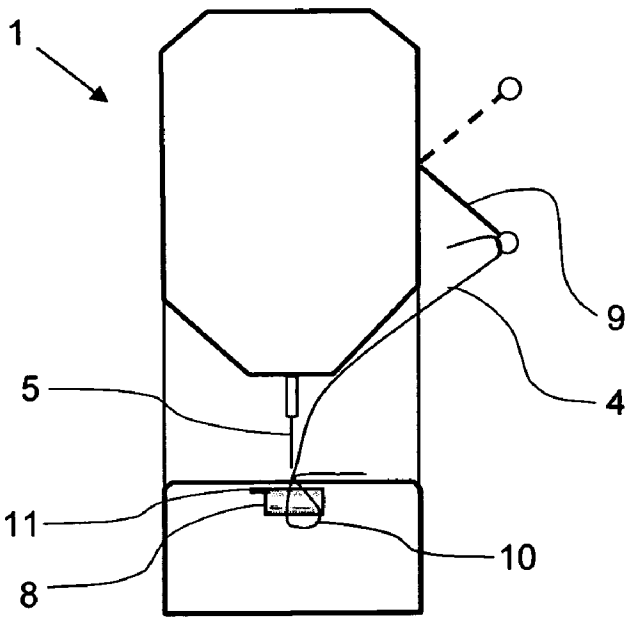
FIG. 2 depicts a schematic template sketch from the side of the sewing machine according to FIG. 1, showing the take-up lever's highest and lowest positions, illustrating the travel distance and also showing a gripper with gripper tip and thread loop within the sewing table.

By way of example of the functioning of a lock stitch sewing machine, FIG. 1 depicts symbolically a sewing machine 1 where in a conventional manner a fabric 2 is fed forward between a lower thread 3 and the upper thread 4 in order to execute a seam comprising desired stitches effected by means of a needle 5, which moves periodically through the fabric 2. In this example, the fabric 2 is moved across a sewing table 6, which also accommodates a horizontally disposed lower bobbin 7 intended for the lower thread 3 and encased in a gripper 8 in a lower arm 1*a* of the sewing machine. The sewing table 6, further, has a stitchplate 6*a* over which the actual seam is executed. The upper thread 4 is led via a take-up lever 9, which by a cyclic up and down movement creates a loop 10 (symbolically indicated in FIG. 2) of the upper thread 4 when the needle 5, through the eye of which the upper thread runs, has carried the upper thread through the fabric 2 and the take-up lever 9 reverses back upwards from its lowest position. A gripper tip 11 hooks into the loop 10 when the gripper 8 rotates. To execute a stitch, in this case a lock stitch, the needle 5 performs a fore and aft movement so that it leads the upper thread 4 down through the fabric 2, after which the gripper 8 leads the upper thread 4 round the bobbin 7, which carries the lower thread 3, resulting in a knot in the fabric 2 when the needle 5 moves up through the fabric and the take-up lever 9 tightens the knot inside the fabric. The diagram also shows a thread magazine 15 for the upper thread. A thread tension sensor spring 14 is also indicated.

The machine is provided with a control program which is, for example, stored in a processor C. The control program conducts at least the control of a stepping motor which regulates the advance of the fabric in a longitudinal feed unit 20.

The feed is the system which causes linear movement of the fabric between stitches in a seam. It comprises a feeder 21, which usually has a number of parallel rods with sawlike teeth at the top and is provided with elongate apertures in the stitch plate disposed in parallel on each side of the position where the needle 5 penetrates the stitch plate, where further an arcuate hole is formed in the stitchplate 6*a* for the needle 5. The feeder 21 can be lowered so that its teeth do not appear above the stitchplate 6*a*. The feeder usually performs a rotary movement whereby it moves up through the stitchplate, grips the fabric with the feeder teeth and moves forward in the longitudinal direction of the seam and thereafter down into the stitchplate and back to the initial position, after which the movement is repeated. The result is that the fabric 2 moves forward in the longitudinal direction of the seam.

Figure 3:
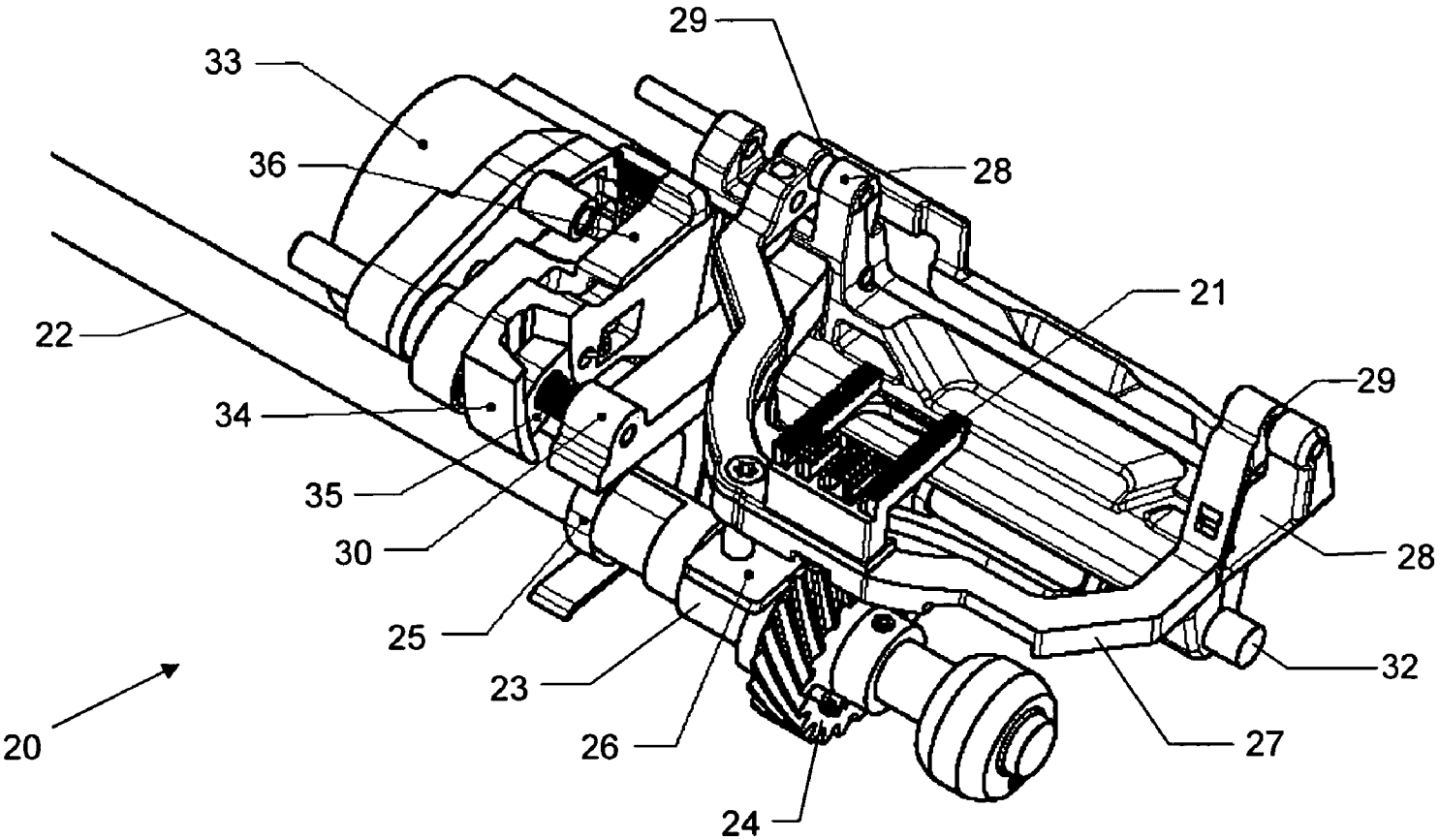
FIG. 3 depicts in perspective a unit for longitudinal feed of fabric in the sewing machine.

A feed unit 20 of the type used in the present invention is depicted in FIG. 3. It should be noted here that the feed mechanism depicted according to the feed unit 20 is an example to indicate one possibility for implementing the invention. Other variants of feed mechanisms might equally well be used, provided that they can be adapted to control the advance according to the aspects of the present invention. The sewing table comprises a so-called table shaft 22 which is driven by the sewing machine motor synchronously with, for example, a needle and a take-up lever. The feed unit 20 is fitted about this table shaft 22. The movements of the feeder are effected by two excenters on the table shaft 22. A first excenter, the height excenter 23, adjacent to a gearwheel 24, which drives the gripper 8, effects the movement of the feeder 21 in the height direction. A second excenter, the longitudinal excenter 25, arranged further inwards on the table shaft 22, effects the movement of the feeder 21 in the longitudinal direction.

A race round the whole periphery of the height excenter 23 abuts a link 26 for height feed, which link performs an oscillating movement in the height direction when the table shaft 22 rotates. The height feed link 26 is supported on a rotation shaft 32 for a longitudinal feed arm 28. A feeder yoke 27 to which the feeder is fastened is directly connected to the height feed link 26 by a slide screw and therefore follows the movement of the height feed link 26 in the height direction.

Similarly, there is round the whole periphery of the longitudinal excenter 25 a race, which a link 30 for longitudinal feed is adapted to abut. The longitudinal feed link 30 has its opposite end fastened to and supported by a longitudinal feed arm 28. The longitudinal feed link 30 also has at the end where it abuts the longitudinal excenter 25 a pin supporting a block 35, which slides in a guide 34 when the longitudinal excenter 25 moves the longitudinal feed link 30 in the height direction. The movement of the longitudinal feed link 30 is transferred to the longitudinal feed arm 28 as a feeder 21 movement a length in the longitudinal direction of the feeder 21, wherein said length depends on the angle of the guide at the time. The result is the desired longitudinal advance of the feeder 21, while at the same time this advance movement is synchronised with the previously described movement of the feeder 21 in the height direction.

The longitudinal feed is a parameter being possible for the user or the sewing machine's control program to determine. To this end, a stepping motor for the feed, a feed motor 33, is adapted to and fitted in the sewing machine arm, i.e. the lower arm 1*a*, and is connected to the feed device via the aforesaid block 35. Said block 35 is connected to the previously mentioned pin and the guide 34. Stitch length resetting is effected via the feed motor 33. In the present example, the geometry of the feed motor 33 is so adapted that each step effected by the motor entails rotation of the motor a predetermined angle of rotation, wherein a change of said angle corresponds to a change of a corresponding predetermined feed length, by which the feeder 21 moves the fabric forward.

According to the state of the art, the stitch length is set by means of the guide 34, which is disposed adjacent to the longitudinal feed link 30 and is also suspended about an axis of rotation so that the guide 34 can be inclined in relation to the longitudinal feed link 30. In this example, the guide is provided with a groove, in which the block 35 can run. The block 35, in turn, is itself connected via said pin to the longitudinal feed link 30, whereby the block 35 is journalled on said pin. The radius of the guide 34 at the groove for the block 35 corresponds to the distance between the journal centre of the block 35 at the pin and the journal centre of the longitudinal feed link 30 at the longitudinal feed arm 28.

When the radius of the guide coincides with the distance from the journal centre of the block 35 to the journal centre of the longitudinal feed link 30 at to the longitudinal feed arm 28, the feed movement will be zero. Turning, i.e. rotating, the guide 34 from this position, will increase the feed. Turning of the guide 34 is accomplished by the feed motor 33 turning a gear segment 36 which is firmly connected to the guide.

Each time the sewing machine is started, the feed motor is calibrated and thereafter steps to a selected stitch length by the aforesaid angling of the guide 34. Compensation of the stitch length error on the fabric relative to the set stitch length occurring during the previously described sideways shift of the needle 5 when the latter executes a very wide stitch can be achieved according to an aspect of the invention by increasing the working range of the mechanical feed components in the same way as described above.

An algorithm described below loaded into a control program for the feed motor 33 controls said feed motor 33 to effect longitudinal feed compensation when a longitudinal feed error is present in stitches for which the needle executes large sideways shifts.

The proposed algorithm may be used for all sewing machines which have a horizontally positioned lower bobbin and a needle movement adapted thereto.

Figure 4:
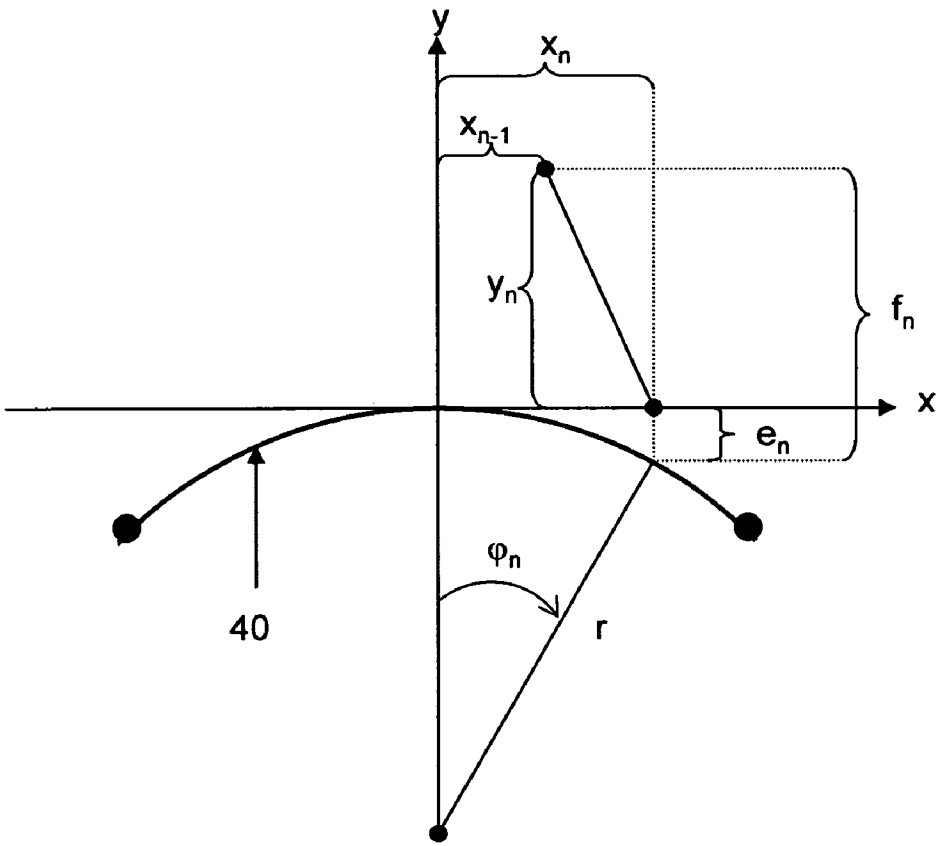
FIG. 4 depicts a sketch of the movement of the needle in a system of coordinates during the execution of a stitch.

In a mechanical platform for sewing machines having a horizontally positioned lower bobbin the needle moves in the plane of the fabric 2 sideways along an arc 40 constituting the periphery of a circle which encircles the rotation radius of the gripper tip. This is illustrated in FIG. 4, in which the movement of the fabric caused by the longitudinal feed is indicated in a system of coordinates along a y coordinate. The needle's sideways movement is represented by the x coordinate. When the needle shifts sideways from the neutral position along the y axis to a new position in the x direction, the result is an undesired shift in the y direction relative to the fabric 2, which undesired shift is particularly evident in the case of large shifts in the x direction. The path of the needle is represented in the diagram by a chain-dotted curve. The depiction according to the diagram also means that the desired position for the stitch entails a lateral shift along the x axis.

The following notations are used below (see FIG. 4):

- $x_n$ Desired distance from the needle's central position in the x direction in a Cartesian system of coordinates for any desired stitch n in a stitch sequence.
- $y_n$ Desired distance in the y direction in a Cartesian system of coordinates for any desired stitch n from stitch n−1 preceding it in a stitch sequence.
- r The radius in a system of polar coordinates with its origin of coordinates at the centre of the curve which the needle's movement describes relative to the surface of the stitchplate, i.e. in the same work the curve of the intersection between the conical surface which the needle's movement follows and the stitchplate.
- $\phi_n$ Angle in a system of polar coordinates with its origin of coordinates at the centre of the curve which the needle's movement describes relative to the surface of the stitchplate for any desired stitch n, where $\phi_n=0$ when $x_n=0$.
- $e_n$ The error, i.e. undesired shift in the y direction for any desired stitch n in a stitch sequence, caused by a circular needle movement along the curve described by the needle movement.

Transformations between rectilinear Cartesian stitch data and polar coordinates also produce the relationships $$\varphi_n = \arcsin\left(\frac{x_n}{r}\right)$$

$$e_n = r(\cos(\varphi_n) - 1)$$

The following notations:

$\phi_n$ Feed motor's position for any desired stitch in a stitch sequence $x_0$ Initial needle position at start of pattern repeat $\Delta_F$ Feed motor's resolution, in mm/step $e_\Delta$ Residual error due to quantisation, in number of stepping motor steps.

$f_n$ Total shift in y direction for any desired stitch n for effecting full error compensation Z(x) Function for rounding to nearest whole number N Total number of stitches in the stitch sequence for a pattern repeat can be used to write an algorithm as follows for control of the feeder 21, wherein $1 \leqq n \leqq N$ for a pattern repeat with the stitch coordinates $\{(x_1, y_1), \ldots, (x_N, y_N)\}$:

$n=1$:

$$f_1 = y_1 - e_1 + e_0$$

$$\Phi_1 = Z(f_1/\Delta_F)$$

$2 \leqq n \leqq N$:

$$e_\Delta = f_{n-1} - \Phi_{n-1} * \Delta_F$$

$$f_n = y_n - e_\Delta - e_n + e_{n-1}$$

$$\Phi_n = Z(f_n/\Delta_F) \quad [1]$$

The theoretical background for effecting compensation is set out above. The solution is effected in practice by the software in the sewing machine's processor being adapted to cause the feed error due to the sideways needle shift to be compensated by a control of the feed motor 33 according to the above outlined algorithm. Since the feed motor in the present example takes the form of a stepping motor which makes discrete steps, account is also taken, in order to achieve the best possible results, of the error which cannot be compensated because of this limited resolution of the stepping motor. An uncompensated residual error from a stitch is saved and added to the calculated total error compensation for the next stitch for as long as error compensation is called for in a sequence of stitches, i.e. until a pattern repeat is completed, whereupon any residual error is zeroed.

As previously mentioned, the sewing machine's software is adapted to perform the calculations needed for said feed error compensation. To this end, the sewing machine is provided with a data program product programmed to do the calculations set out equation [1] above.

For compensation of the fabric feed error to be possible, the fabric feed device needs to be able to effect feed movements which extend beyond the usual range of a sewing machine which lacks the compensation described. If for example the concept of the present invention is used for an ordinary sewing machine provided with the longitudinal feed range from −6.0 mm to +6.0 mm, the maximum stitch width of the machine using the concept of the present invention can be set to 9 mm and the needle tip moves along the aforesaid arcuate path at a radius of 18.45 mm, the longitudinal feed device has to cope with a somewhat larger range than in previously known machines, in this case a stitch length range of from −6.588 mm to +6.588 mm. Some examples of this appear in the table below.

| $\lvert X_n \rvert$ | $\theta_n$ |
|---|---|
| 0.000 | 0.000 |
| 1.000 | −0.029 |
| 2.000 | −0.115 |
| 3.000 | −0.259 |
| 4.000 | −0.463 |
| 4.500 | −0.588 |

If the stepping motor which constitutes the feed motor 33 is adapted to microcontrol, i.e. not making discrete feed steps, there will of course be no need to cater for residual error in a stitch.

The invention claimed is:

1. A sewing machine, comprising:

a needle provided with an upper thread;

a gripper housing a horizontally fitted lower bobbin for a lower thread;

a feeder for feeding a sewing material being sewn between the upper thread and the lower thread;

a drive configured to cause the needle to perform an oscillating movement up and down in order to carry the upper thread through the material so that the upper thread forms a loop under the sewing material;

a gripper tip on the gripper hooking the loop of the upper thread and carrying the upper thread round the lower bobbin;

a take-up lever tightening inside the material a knot of the upper thread and the lower thread in cooperation so that a stitch is accomplished and forms a seam;

means causing, when the needle in a stitch performs a sideways shift relative to a longitudinal direction of the seam, the needle to run along a conical surface which in the plane of the sewing material has the form of an arcuate curve corresponding to an arcuate curve of the periphery of the gripper;

a feed motor causing the feeder to advance the sewing material by means of the feeder a length y in the longitudinal direction of the seam, on the basis of a seam setting; and a control comprising an algorithm by which the feed motor is controlled to act upon the feeder in each stitch including a sideways shift of the needle to advance the sewing material a correction length $e_n$ in the longitudinal direction of the seam, thereby compensating a corresponding deficiency in the longitudinal shift of the needle relative to the material during the stitch caused by the arcuate sideways movement of the needle.

2. The sewing machine according to claim 1, wherein said control comprises a processor programmed with said algorithm.

3. The sewing machine according to claim 1, wherein said feed motor comprises a stepping motor.

4. A method applicable to a sewing machine having a needle and a gripper with a horizontally positioned lower bobbin for executing a seam by stitches in a sewing material, for compensating a deficiency in a longitudinal shift of the needle during a stitch caused by an arcuate movement of the needle when it shifts sideways in the stitch, the method comprising:

advancing the sewing material a length $y_n$ in the longitudinal direction of the seam on the basis of a seam setting utilizing a feeder;

utilizing an algorithm provided in a control for controlling a feeder motor advancing said feeder; and setting said feeder using said controlling for stitches entailing sideways shifting of the needle, to feed the sewing material a correction length $e_n$ in the longitudinal direction of the seam, thereby compensating a corresponding deficiency, in the longitudinal shift of the needle in relation to the sewing material during the stitch, caused by the arcuate sideways movement of the needle.

5. The method according to claim 4, further comprising:

setting mechanical elements utilizing said control to effect said correction length $e_n$.

6. The method according to claim 4, wherein $y_n$ represents a desired shift in a y direction for stitch n in relation to the sewing material, $f_n$ represents a total shift in the y direction of the sewing material for stitch n to achieve a full error compensation, $e_A$ represents a residual error due to a quantisation, in a number of stepping motor steps, $e_n$, $e_{n-1}$ represent an error in a y position in relation to the sewing material for stitch n and stitch n−1 respectively, and N represents a number of stitches in a seam sequence for a pattern report, the method further comprising:

calculating in the algorithm a total need for shifting $f_n$ of the material by the feeder in the longitudinal direction according to:

$$n=1:$$

$$f_1=y_1-e_1+e_0$$

$$\Phi_1=Z(f_1/\Delta_F)$$

$$2\leqq n\leqq N:$$

$$e_\Delta=f_{n-1}-\Phi_{n-1}*\Delta_F$$

$$f_n=y_n-e_\Delta-e_n+e_{n-1}$$

$$\Phi_n=Z(f_n/\Delta_F). \quad [1]$$

7. The method according to claim 6, wherein:

$\Phi_n$ represents a position of a feed motor for an arbitrary stitch in a stitch sequence, $\Delta_F$ represents a resolution of the feed motor in mm/step, and Z(x) represents a function for rounding to nearest whole number the method further comprising:

calculating in the algorithm the position $\Phi_n$ for the feed motor according to:

$$n=1:$$

$$\Phi_1=Z(f_1/\Delta_F)$$

$$2\leqq n\leqq N:$$

$$\Phi_n=Z(f_n/\Delta_F). \quad [1]$$

8. The method according to claim 7, wherein $f_{n-1}$ represents a total shift of the sewing material effected by the feeder in the y direction for a stitch n−1 preceding a current stitch n, and $\Phi_{n-1}$ represents a position of the feed motor for a preceding stitch in a stitch sequence the method further comprising:

calculating, utilizing the algorithm, a residual error $e_\Delta$ in the y position in relation to the sewing material for stitch n, caused by the position of the feed motor being quantified according to:

$$e_\Delta=f_{n-1}-\Phi_{n-1}*\Delta_F.$$

9. The method according to claim 6, further comprising:

a) commencing a pattern report;

b) calculating a feed length $f_n$ for a new stitch including said correction length $e_n$;

c) utilizing the feed motor to control the longitudinal feed unit for feeding the sewing material forward a feed length $f_n$ according to said calculation; and d) commencing a new stitch according to step b) until the pattern report is complete, whereupon step a) is repeated unless the sewing is ended.

10. The method according to claim 9, further comprising:

compensating the calculation of the feed length $f_n$ according to step b) by said residual error $e_\Delta$ on the basis of quantisation, in number of stepping motor steps.

11. A computer program product programmed to perform calculations for compensating a deficiency in a longitudinal shift of a needle during a stitch caused by an arcuate movement of the needle when the needle shifts sideways in the stitch in order to arrive at a correction length $e_n$, the computer program product comprising:

a non-transitory computer readable medium; and computer program instructions recorded on the computer readable medium and executable by a processor for carrying out a method comprising advancing a sewing material a length in a longitudinal direction of a seam based on a seam setting utilizing a feeder, utilizing an algorithm provided in a control for controlling a feeder motor advancing said feeder, and setting said feeder using said control for stitches including sideways shifting of the needle, to feed the sewing material a correction length in the longitudinal direction of the seam, thereby compensating a corresponding deficiency, in longitudinal shift of the needle in relation to the sewing material during the stitch, caused by the arcuate sideways movement of the needle.

* * * * *

UNITED STATES PATENT AND TRADEMARK OFFICE

CERTIFICATE OF CORRECTION

PATENT NO. : 8,100,071 B2
APPLICATION NO. : 11/878251
DATED : January 24, 2012
INVENTOR(S) : Rolf Janeke et al.

It is certified that error appears in the above-identified patent and that said Letters Patent is hereby corrected as shown below:

Col. 9, line 6, change "$e_A$" to --$e_\Delta$--

Signed and Sealed this
Twelfth Day of February, 2013

Teresa Stanek Rea
*Acting Director of the United States Patent and Trademark Office*